United States Patent [19]

Raemdonck et al.

[11] Patent Number: 4,758,378

[45] Date of Patent: Jul. 19, 1988

[54] SOFTENING DETERGENT COMPOSITIONS CONTAINING AMIDE SOFTENING AGENT

[75] Inventors: Hans Raemdonck, St.-Denijs Westrem; Alfred Busch, Strombeek-Bever, both of Belgium; Frederick E. Hardy, Newcastle upon Tyne, United Kingdom

[73] Assignee: The Procter & Gamble Company, Cincinnati, Ohio

[21] Appl. No.: 40,434

[22] Filed: Apr. 20, 1987

[30] Foreign Application Priority Data

Apr. 23, 1986 [GB] United Kingdom ..... 8609883

[51] Int. Cl.[4] ..... C11D 3/32; D06M 13/40

[52] U.S. Cl. ..... 252/544; 252/8.8; 252/94; 252/545; 252/546; 252/525; 252/DIG. 1; 252/DIG. 17

[58] Field of Search ..... 252/8.8, 94, DIG. 1, 252/DIG. 17, 544, 525, 545, 546

[56] References Cited

U.S. PATENT DOCUMENTS

| | | | |
|---|---|---|---|
| 3,632,420 | 1/1972 | Kuhn | 117/138.8 F |
| 3,966,629 | 6/1976 | Dumbrell | 252/140 |
| 4,077,890 | 3/1978 | Barker | 252/8.8 |
| 4,283,192 | 8/1981 | Bauman | 8/137 |
| 4,292,035 | 9/1981 | Battrell | 8/137 |
| 4,294,710 | 10/1981 | Hardy et al. | 252/8.8 |
| 4,321,157 | 3/1982 | Harris et al. | 252/174.25 |
| 4,338,204 | 7/1982 | Spadini et al. | 252/8.75 |
| 4,375,416 | 3/1983 | Crisp et al. | 252/8.7 |
| 4,497,715 | 2/1985 | Bauman | 252/8.8 |
| 4,497,716 | 2/1985 | Tai | 252/8.8 |
| 4,514,444 | 4/1985 | Ives et al. | 427/242 |
| 4,578,200 | 3/1986 | St. Laurent et al. | 252/8.8 |

FOREIGN PATENT DOCUMENTS

| | | |
|---|---|---|
| 0159918 | 1/1985 | European Pat. Off. . |
| 133804 | 3/1985 | European Pat. Off. . |
| 000225 | 1/1986 | European Pat. Off. . |
| 168889 | 1/1986 | European Pat. Off. . |
| 1959007 | 5/1971 | Fed. Rep. of Germany . |
| 3310417 | 9/1984 | Fed. Rep. of Germany . |
| 58-144175 | 8/1983 | Japan . |
| 1367261 | 9/1974 | United Kingdom . |
| 1400898 | 7/1975 | United Kingdom . |
| 1514276 | 6/1978 | United Kingdom . |
| 2040988 | 2/1979 | United Kingdom . |
| 2134143 | 7/1984 | United Kingdom . |

OTHER PUBLICATIONS

Pending U.S. patent application Ser. No. 40,404, Raemdonck et al, filed Apr. 20, 1987.

*Primary Examiner*—Paul Lieberman
*Assistant Examiner*—Ronald A. Krasnow
*Attorney, Agent, or Firm*—Donald E. Hasse; Richard C. Witte; Thomas H. O'Flaherty

[57] ABSTRACT

Detergent compositions capable of providing through-the-wash softness and other fabric-care benefits are disclosed, which contain a specific amide softening agent.

9 Claims, No Drawings

SOFTENING DETERGENT COMPOSITIONS CONTAINING AMIDE SOFTENING AGENT

TECHNICAL FIELD

The present invention relates to softening detergent compositions containing a narrowly-defined amide softening agent.

The compositions herein, in addition to providing good cleaning performance, exhibit excellent through-the-wash softening properties, and provide additional fabric-care benefits such as anti-static, anti-wrinkling, ease-of-ironing and color stability.

BACKGROUND OF THE INVENTION

Formulators of fabric treatment compositions have long sought means for simultaneously washing and softening fabrics. Among the various approaches suggested are methods employing clay softeners, or amine materials, or both ingredients in combination, such as described in e.g.: German Pat. Nos. 29.64.114, 28.57.16, 24.39.541, 23.34.899 and European Pat. Nos. 0 026 528 and 0 028 432.

Amines have been used in combination with soaps (U.K. Pat. No. 1 514 276) fatty acids (published E.P.A. No. 0 133 804) or phosphate esters (published E.P.A. No. 0 168 889) as through-the-wash softeners.

The formulation of the art through-the-wash softening detergent compositions can, however, be subject to flexibility problems which are often due to incompatibility between certain ingredients (between e.g. peroxyacid bleaching agents and softening agents).

Carboxy-amides have been used as antistatic agents in industrial textile treatment (German Pat. No. 30 43 618) and N-alkyl isostearamides as antistatic agents in laundry application (French Pat. No. 2,531,447). Japanese Pat. No. J5 8144-175-A discloses the industrial treatment of textile by cationic softening agents and ethoxylated fatty acid amides.

Alkoxylated fatty amides are known as surfactants (EP No. 0 000 595) and as viscosity control agents (EP No. 0 112 719).

German patent application No. 19 59 007 discloses the use as softening agent of a monoethanolamide. German patent application No. 33 10 417 discloses the use of fatty acids diethanolamides as antistatic/non-yellowing agents.

None of the above documents discloses the use of the specific amides of the present invention in softening detergent compositions.

It is an object of the present invention to provide detergent compositions capable of providing excellent cleaning, softening, and fabric-care properties.

It is a further object of the invention to provide softening detergent compositions which can be formulated with increased flexibility, in particular in presence of peroxyacid bleaching compounds.

Indeed, it has now been discovered that the use of a narrowly-defined class of amides as softening agents in detergent compositions provides excellent results in both cleaning and softening of fabric, as well as other "fabric care" benefits, possibly in the presence of peroxyacid bleaching agents.

SUMMARY OF THE INVENTION

The present invention relates to detergent compositions, capable of giving through-the-wash fabric-care benefits inclusive of softeness, containing detersive surfactants, a nitrogen-containing fabric softening agent and, if desired detersive additives, are characterized in that the nitrogen-containing softening agent is an amide having the formula:

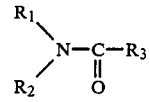

(i)

wherein $R_1$ and $R_2$ are, selected independently, $C_{1-22}$ alk(en)yl, hydroxy alkyl, aryl, or alkyl-aryl groups, $R_3$ is hydrogen, or a $C_{1-22}$ alk(en)yl, aryl or alkyl-aryl group, or is O—$R_4$, wherein $R_4$ is a $C_{1-22}$ alk(en)yl, aryl or alkyl-aryl group, $R_3$ and $R_4$ possibly containing 1 to 10 ethylene oxide units, or functional groups selected from hydroxy, amine, amide, ester, and ether groups; the aryl groups being possibly derived from hetero-cyclic compounds; with the provisos that at least one of the $R_1$ and $R_2$ groups contains 10 or more carbon atoms; and the sum of carbon atoms in $R_1+R_2+R_3$ is equal to or greater than 14.

DETAILED DESCRIPTION OF THE INVENTION

The amide softening agent

The amide softening agents for use in the present invention can be represented by the formula:

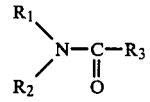

(i)

wherein $R_1$ and $R_2$ are, selected independently, $C_{1-22}$ alk(en)yl aryl, or alkyl aryl groups, $R_3$ is hydrogen, or a $C_{1-22}$ alk(en)yl, aryl or alkyl-aryl group, or is O—$R_4$, wherein $R_4$ is a $C_{1-22}$ alk(en)yl, aryl or alkyl-aryl group, $R_3$ and $R_4$ possibly containing 1 to 10 ethylene oxide units, or functional groups selected from hydroxy, amine, amide, ester, and ether groups; the aryl groups being possibly derived from hetero-cyclic compounds; at least one of $R_1$ and $R_2$ groups contains 10 or more carbon atoms; the sum of carbon atoms in $R_1+R_2+R_3$ is equal to or greater than 14. Preferably, the sum of carbon atoms in $R_1+R_2$ is equal to or greater than 16.

Most preferred in the context of the present invention are amides of the formula (i), wherein the sum of carbon atoms in $R_1+R_2$ is greater than 16 and $R_3$ is an alk(en)yl group containing from 1 to 6 carbon atoms or is an alkyl phenyl group containing up to 4 carbon atoms in the alkyl chain.

Such species include N,N-ditallow acetamide, N,N-dicoconut acetamide, N,N-dioctadecyl propanamide, N-dodecyl, N-octadecyl acetamide, N-hexadecyl, N-dodecyl butanamide, N,N-ditallow benzamide, N,N-dicoconut benzamide, N,N-ditallow 2-phenyl acetamide.

Most preferred are N,N-ditallow acetamide, N,N dicoconut acetamide, N,N-ditallow benzamide.

Examples of compound of formula (i) wherein $R_3$ contains hydroxy groups and/or ether linkages include N,N-ditallow 2-hydroxy acetamide, N,N-ditallow 3-hydroxy propanamide, N,N-ditallow 2-methoxy acetamide, N,N-ditallow 2-ethoxy acetamide, N,N-ditallow 3-methoxy propanamide.

Examples of compound of formula (i) wherein $R_3$ is —O—$R_4$ include N,N-ditallow alkoxycarboxylamines and N,N dicoconut alkoxy-carboxylamines, with the alkoxy group being preferably methoxy, ethoxy or propoxy.

The amide softening agent is used at levels of from 0.1% to 15% by weight, preferably form 1% to 10% by weight, most preferably from 3% to 6% by weight.

In a highly preferred embodiment, the amide softening agent is pre-mixed (predispersed) with a dispersing agent, and the resulting mixture is then added to the rest of the composition.

Any conventional dispersing agent can be used for that purpose. Examples of suitable dispersing agents include nonionic surfactants resulting from the condensation of primary or secondary aliphatic alcohols e.g. tallow alcohol or alkyl phenol, with from 5–12 ethylene oxide units; and phosphate esters as described in European patent application No. 85201127.9, having the formula:

$$R'—O(CH_2—CH_2O)_mPO(OH)_2,$$

with $R'=C_{12-14}$ and $m=1-5$, sold under the Trade Name "Servoxyl VPAZ".

In a particularly preferred embodiment, fatty acids are used as dispersing agents for the amide softener. Fatty acids having from 10 to 20 carbon atoms in the alkyl chain like lauric, myristic, palmitic, stearic, oleic acids and mixtures thereof can advantageously be used in the present context. Especially preferred is a mixture of palmitic and stearic acids.

Fatty acid dispersing agents are used most preferably in a weight ratio of 1/1 to 10/1 of amide softening agent to fatty acid.

Detersive surfactants

The compositions of this invention will typically contain organic surface-active agents ("surfactants") to provide the usual cleaning benefits associated with the use of such materials.

Detersive surfactants useful herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alkyl phenols, amine oxides, alpha-sulfonates of fatty acids and of fatty acid esters, and the like, which are well-known from the detergency art. In general, such detersive surfactants contain an alkyl group in the $C_9$–$C_{18}$ range; the anionic detersive surfactants can be used in the form of their sodium, potassium or triethanolammonium salts; the nonionics generally contain from about 5 to about 17 ethylene oxide groups. U.S. Pat. No. 4,111,855 contains detailed listings of such typical detersive surfactants. $C_{11}$–$C_{16}$ alkyl benzene sulfonates, $C_{12}$–$C_{18}$ paraffin-sulfonates and alkyl sulfates, and the ethoxylated alcohols and alkyl phenols are especially preferred in the compositions of the present type.

Also useful herein as the surfactant are the water-soluble soaps, e.g. the common sodium and potassium coconut or tallow soaps well-known in the art.

The surfactant component can comprise as little as 1% of the compositions herein, but preferably the compositions will contain 5% to 40%, preferably 10% to 30%, of surfactant. Mixtures of the ethoxylated nonionics with anionics such as the alkyl benzene sulfonates, alkyl sulfates and paraffin sulfonates are preferred for through-the-wash cleansing of a broad spectrum of soils and stains from fabrics.

Detersive adjuncts

The amide softening agent is preferably, without this being an essential requirement, used in combination with a detergent-compatible clay softener. Such clay softeners are well-known in the detergency art and are in broad commercial use, both in Europe and in the United States. Included among such clay softeners are various heat-treated kaolins and various multi-layer smectites. Preferred clay softeners are smectite softener clays that are described in German Patent Application No. 23 34 899 and in U.K. Pat. No. 1,400,898, which can be referred to for details. Softener clays are used in the preferred compositions at levels of at least 1%, generally 1–20%, preferably 2–10%.

The compositions herein can contain other ingredients which aid in their cleaning performance. For example, the compositions herein can advantageously contain a bleaching agent, especially a peroxyacid bleaching agent, without any prejudice to the stability and overall performance, thanks to the compatibility of the amide softening agents of the invention with peroxyacid bleaching agents. In the context of the present invention, the term peroxyacid bleaching agent encompasses both peroxyacids per se and systems which are able to yield peroxyacids in situ.

Peroxyacids per se are meant to include the alkaline and alkaline-earth metal salts thereof. Peroxyacids and diperoxyacids are commonly used; examples are diperoxydodecanoic acid (DPDA) or peroxyphthalic acid.

Systems capable of delivering peracids in situ consist of a peroxygen bleaching agent and an activator therefor.

The peroxygen bleaching agents are those capable of yielding hydrogen peroxide in an aqueous solution; those compounds are well-known in the art, and include hydrogen peroxide, alkali-metal peroxides, organic peroxide bleaching agents such as urea peroxide, inorganic persalt bleaching agents such as alkali metal perborates, percarbonates, perphosphates, persilicates, and the like.

Preferred are sodium perborate, commercially available in the form of mono- and tetra-hydrates, sodium carbonate peroxyhydrate, sodium pyrophosphate peroxyhydrate and urea peroxyhydrate.

The liberated hydrogen peroxide reacts with the bleach activator to form the peroxyacid bleach. Classes of bleach activators include esters, imides, imidazoles, oximes, and carbonates. In those classes, preferred materials include methyl o-acetoxy benzoates; sodium-p-acetoxy benzene sulfonates such as sodium 4-nonanoxyloxybenzene sulfonate; sodium-4-octanoyloxybenzene sulfonate, and sodium-4-decanoyloxybenzenesulfonate; biophenol A diacetate; tetra acetyl ethylene diamine; tetra acetyl hexamethylene diamine; tetra acetyl methylene diamine.

Other highly preferred peroxygen bleach activators which are disclosed in U.S. Pat. Nos. 4,483,778 and 4,539,130, are alpha-substituted alkyl or alkenyl esters, such as sodium-4(2-chlorooctanoyloxy)benzene sulfonate, sodium 4-(3,5,5-trimethyl hexanoyloxy)benzene sulfonate. Suitable peroxyacids are also peroxygen bleach activators such as described in published European Patent Application No. 0 116 571, i.e., compounds of the general type RXAOOH and RXAL, wherein R is a hydroxcarbyl group, X is a hetero-atom, A is a carbonyl bridging group and L is a leaving group, especially oxybenzenesulfonate.

The compositions herein may contain alternatively any other type of bleaching agent, conventionally used in detergent compositions. Also, it is highly preferred that through-the-wash detergent compositions contain a detergent builder and/or metal ion sequestrant. Compounds classifiable and well-known in the art as detergent builders include the nitrilotriacetates, polycarboxylates, citrates, water-soluble phosphates such as tri-polyphosphate and sodium ortho- and pyro-phosphates, silicates, and mixtures thereof. Metal ion sequestrants include all of the above, plus materials like ethylenediaminetetraacetate, the amino-polyphosphonates and phosphates (DEQUEST) and a wide variety of other poly-functional organic acids and salts too numerous to mention in detail here. See U.S. Pat. No. 3,579,454 for typical examples of the use of such materials in various cleaning compositions. In general, the builder/sequestrant will comprise about 0.5% to 45% of the composition. The 1–10 micron size zeolite (e.g. zeolite A) builders disclosed in German Pat. No. 24 22 655 are especially preferred for use in low-phosphate or non-phosphate compositions.

The laundry compositions herein also preferably contain enzymes to enhance their through-the-wash cleaning performance on a variety of soils and stains, such as amylase & protease enzymes. Amylase and protease enzymes suitable for use in detergents are well-known in the art and in commercially available liquid and granular detergents. Commercial detersive enzymes (preferably a mixture of amylase and protease) are typically used at levels of 0.001% to 2%, and higher, in the present compositions. Other highly desirable detergent ingredients for use in the detergent compositions of the present invention are quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_4$ alkyl preferably methyl: $X^-$ is an anion, e.g. chloride. Examples of such quaternary ammonium compounds include $C_{12}$–$C_{14}$ alkyl trimethyl ammonium chloride and cocoalkyl trimethyl ammonium methosulfate. The quaternary ammonium compounds can be used at levels from 0.5% to 5%, preferably from 1% to 3%.

Moreover, the compositions herein can contain, in addition to ingredients already mentioned, various other optional ingredients typically used in commercial products to provide aesthetic or additional product performance benefits. Typical ingredients include pH regulants, perfumes, dyes, optical brighteners, soil suspending agents, hydrotropes and gel-control agents, freeze-thaw stabilizers, bactericides, preservatives, suds control agents, bleach stabilizing agents.

In a through-the-wash mode, the compositions are typically used at a concentration of at least 500 ppm, preferably 0.10% to 1.5%, in an aqueous laundry bath at pH 7–11 to launder fabrics. The laundering can be carried out over the range from 5° C. to the boil, with excellent results.

Form and Preparation of the compositions

The detergent compositions of this invention can be present in any suitable physical state inclusive of granular, liquid, pasty, or sheet-like form. They may be prepared in any way, as appropriate to their physical form, by mixing the components, co-agglomerating them, micro-encapsulating them, dispersing them in a liquid carrier, and releasably adsorbing or coating them onto a non-particulate substrate, such as a non-woven or paper sheet.

Preferably, the compositions are in granular form.

A highly preferred method of preparation of said granular compositions consists in preparing a melt of the dispersing agent and the amide, dispersing the molten mixture into a stirred, aqueous crutcher mix comprising the balance of the detersive ingredients, and spray-drying in standard fashion. In alternate but much less preferred modes, the melt can be atomized onto the detergent granule or allowed to solidify, ground in a colloid mill, and dry-mixed with the balance of the detergent composition. The compositions herein may also be sprayed onto particles of, e.g., sodium perborate mono or tetrahydrate, sodium sulfate, sodium carbonate, sodium silicate, sodium phosphate, or clay of the type described above.

INDUSTRIAL APPLICATION

The following examples are typical of the preferred execution of the invention, but are not intended to limit the scope.

EXAMPLE 1

Ditallow acetamide (total 6% of complete formulation after spray-drying) and stearic acid (2% of complete formulation) are admixed, melted in a jacketed batch and stirred until homogeneity. A standard aqueous crutcher mix comprising the following ingredients is prepared (percentages listed relate to percent ingredients in the complete formulation after spray-drying).

| Ingredients | Percent |
|---|---|
| $C_{11}$–$C_{12}$ alkyl benzene sulfonate | 6.2 |
| Tallow alcohol ethoxylate (EO11) | 1.0 |
| Sodium tripolyphosphate | 24.0 |
| Sodium sulfate | 15.0 |
| Sodium silicate | 8.0 |
| Smectite clay* | 6.5 |
| Carboxymethyl cellulose | 0.4 |
| Polyacrylate (soil suspender) | 1.7 |
| Enzymes | 0.5 |
| Optical brightener | 0.23 |
| Sulfonated zinc phthalocyanine** | 25 ppm |
| EDTA | 0.2 |
| Perfume/copper salts/minors | 0.5 |
| $C_{12}$–$C_{14}$ alkyl trimethylammonium chloride | 1.9 |
| Moisture | to 77% |

The ditallow acetamide/stearic acid melt is poured into the crutcher mix (60–90° C.). The crutcher mix-plus-ditallow acetamide/stearic acid is then handled in entirely standard fashion, and spray-dried to form the final composition. After drying sodium perborate (20%) and bleach activator (3% 3-5-5-trimethyl hexanoic acid, sulfaphenyl ester, sodium salt***) are dry-mixed with the granules.

*Natural smectite: ion exchange capacity above 50 meq/100 g clay

**U.S. Pat. No. 3.927.967

***U.S. Pat. Nos. 4.483.778 & 4.539.130.

The composition of Example 1 was compared for through-the-wash softeness vs. an identical composition which did not contain the ditallow acetamide/stearic acid premix (reference). The design of the test was such as to compare softeness of textile pieces laundered 1 time (monocycle) and 4 times (multi-cycle) with invention and reference composition.

The testing conditions were as follows:

automatic drum washing machine MIELE 423 heating up from 15° C. to 60° C.; 50′ at 60° C.

1% product concentration in wash liquor 18 grains/gallon (0.31 g/l) water hardness (3:1 Ca/Mg ratio).

The washed and line dried swatches were compared by a panel of two expert judges, working independently, by a paired comparison technique using a 9-point Scheffe scale. Differences were recorded in panel score units (psu), positive being performancewise better and the least significant difference (LSD) at 95% confidence was also calculated.

The testing results were as follows:

| | Softness (Ex. 1 vs. Reference) | |
|---|---|---|
| | 1 cycle | 4 cycles |
| Terry fabric (12) | +0.46 (0.49)* | +0.96 (0.44) |
| Polyester fabric (12) | +0.76 (0.63) | +1.00 (0.00) |

*value between parentheses is LSD value (see text)

These results show the significant through-the-wash softeness benefits derivable from the composition of Example 1.

EXAMPLE 2

Ditallowbenzamide (5% of complete formulation) and stearic acid (1% of complete formulation) are admixed, melted in a jacketed batch and stirred until homogeneity. A standard aqueous crutcher rinse comprising the following ingredients is prepared (percentages listed relate to percent ingredients in the complete formulation after spray-drying).

| Ingredients | Percent |
|---|---|
| $C_{11}$–$C_{12}$ alkyl benzene sulfonate | 6.2 |
| Tallow alcohol ethoxylate (EO11) | 1.0 |
| Sodium tripolyphosphate | 24.0 |
| Sodium sulfate | 15.0 |
| Sodium silicate | 8.0 |
| Smectite clay* | 6.5 |
| Carboxymethyl cellulose | 0.4 |
| Polyacrylate (soil suspender) | 1.7 |
| Enzymes | 0.5 |
| Optical brightener | 0.23 |
| Sulfonated zinc phthalocyanine** | 25 ppm |
| EDTA | 0.2 |
| Perfume/copper salts/minors | 0.5 |
| $C_{12}$–$C_{14}$ alkyl trimethylammonium chloride | 1.9 |
| Moisture | to 77% |

The ditallowbenzamide/stearic acid melt is poured into the crutcher mix (60–90° C.). The crutcher mix-plus-ditallow acetamide/stearic acid is then handled in entirely standard fashion, and spray-dried to form the final composition. After drying sodium perborate (20%) and bleach activator (3% 3-5-5-trimethyl hexanoic acid, sulfaphenyl ester, sodium salt***) are dry-mixed with the granules.
*Natural smectite: ion exchange capacity above 50 meq/100 g clay
**U.S. Pat. No. 3.927.967
***U.S. Pat. Nos. 4.483.778 & 4.539.130.

The composition of Example 2 was compared for through-the-wash softeness vs. an identical composition which did not contain the ditallowbenzamide/stearic acid premix (reference). The design of the test was such as to compare softeness of textile pieces laundered 1 time (monocycle) and 4 times (multi-cycle) with invention and reference composition.

The testing conditions were as follows:
automatic drum washing machine MIELE 423
heating up from 15° C. to 60° C.; 50' at.60° C.
1% product concentration in wash liquor
18 grains/gallon (0.31 g/l) water hardness (3:1 Ca/Mg ratio).

The washed and line dried swatches were compared by a panel of two expert judges, working independently, by a paired comparison technique using a 9-point Scheffe scale. Differences were recorded in panel score units (psu), positive being performancewise better and the least significant difference (LSD) at 95% confidence was also calculated.

The testing results were as follows:

| | Softness (Ex. 2 vs. Reference) | |
|---|---|---|
| | 1 cycle | 4 cycles |
| Terry fabric (12) | +1.30 (0.48)* | +1.62 (0.71)* |

*value between parentheses is LSD value (see text)

These results show the significant through-the-wash softeness benefits derivable from the composition of Example 2.

EXAMPLE 3

A low-P spray-dried detergent formulation is a follows:

| Ingredients | Percent |
|---|---|
| Zeolite A (1–10 microns) | 26.0 |
| Sodium nitrilotriacetate | 5.0 |
| Smectite clay* | 3.0 |
| Ditallow acetamide/stearic acid (10:1 wt ratio)** | 5.0 |
| $C_{11}$–$C_{12}$ alkyl benzene sulfonate | 6.5 |
| Tallow ethoxylate (EO 9–11) | 0.5 |
| Sodium perborate $4H_2O$*** | 20 |
| Tetraacetyl ethylenediamine (TAED)*** | 3 |
| Sodium silicate | 8 |
| CMC | 1 |
| Sodium sulfate | 18 |
| Enzymes (1:1 amylase/protease)*** | 1.5 |
| Optical brightener | 0.5 |
| Water, minors | to 100 |

*As Gelwhite GP (TM): $CaCO_3$ ion exchange capacity 70 Meq/100 g
**Prepared as in Example 1
***Dry-mixed with composition.

The composition of Example 3 is prepared by spray-drying in aqueous crutcher mix, in the manner described for Example 1. The composition of Example 3 provides better softeness than the composition wherein the amide/stearic acid complexes have been replaced by additional sodium sulfate.

We claim:

1. A detergent composition comprising:

(1) from about 1% to about 40% by weight of a detergent surfactant selected from the group consisting of anionic, nonionic, amphoteric and zwitterionic surfactants, and mixtures thereof; and (2) from about 0.1% to about 15% by weight of a nitrogen-containing fabric softener which is an amide having the formula:

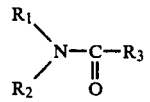

(i)

wherein $R_1$ and $R_2$ are, selected independently, $C_{1-22}$ alkyl, alkenyl, hydroxy-alkyl, aryl, or alkyl-aryl groups, $R_3$ is hydrogen, or a $C_{1-22}$ alkyl, alkenyl, aryl or alkyl-aryl group, or is O-$R_4$, wherein $R_4$ is a $C_{1-22}$ alkyl, alkenyl, aryl or alkyl-aryl group, and $R_3$ and $R_4$ can further comprise 1 to 10 ethylene oxide units, or hydroxy, amine, amide, ester, and ether groups; with the provisos that:

at least one of the $R_1$ and $R_2$ groups contains 10 or more carbon atoms; and the sum of the carbon atoms in $R_1+R_2+R_3$ is equal to or greater than 14.

2. A composition in accordance with claim 1 wherein the amide softening agent is predispersed with a dispersing agent selected from the group consisting of:

nonionic surfactants resulting from the condensation of primary or secondary aliphatic alcohols or alkyl phenol, with polyethylene oxide; and phosphate esters having the formula $$R'—O(CH_2—CH_2O)_mPO(OH)_2,$$

with $R'=C_{12}$–$C_{14}$ and $m=1$–$5$; and fatty acids having from 10 to 20 carbon atoms in the alkyl chain.

3. A composition in accordance with claim 2 wherein the dispersing agent is a fatty acid having from 10 to 20 carbon atoms in the alkyl chain and is present in a weight ratio of amide softening agent to fatty acid of from 1:1 to 10:1.

4. A composition in accordance with claim 1 wherein the sum of carbon atoms in $R_1$ and $R_2$ is greater than 16.

5. A composition in accordance with claim 1, wherein $R_3$ is an alkyl or alkenyl group containing from 1 to 6 carbon atoms, or is an alkyl phenyl group containing from up to 4 carbon atoms in the alkyl chain.

6. A composition in accordance with claim 1 wherein the amount of amide softening agent is from about 1% to about 10% by weight.

7. A composition in accordance with claim 1 wherein the softening agent is: ditallow acetamide, ditallow benzamide, or dicoconut acetamide.

8. A composition in accordance with claim 1 which in addition contains a peroxyacid bleaching compound.

9. A composition in accordance with claim 8 wherein the peroxyacid bleaching compound is comprised of a peroxygen bleaching compound and an activator therefor.

* * * * *